US011074848B2

(12) United States Patent
Ji

(10) Patent No.: US 11,074,848 B2
(45) Date of Patent: Jul. 27, 2021

(54) CONTROL CIRCUIT, DISPLAY APPARATUS, AND CONTROL METHOD FOR CONTROL CIRCUIT

(71) Applicant: HKC CORPORATION LIMITED, Guangdong (CN)

(72) Inventor: Feilin Ji, Guangdong (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 17/043,103

(22) PCT Filed: Dec. 19, 2018

(86) PCT No.: PCT/CN2018/122163
§ 371 (c)(1),
(2) Date: Sep. 29, 2020

(87) PCT Pub. No.: WO2020/098064
PCT Pub. Date: May 22, 2020

(65) Prior Publication Data

US 2021/0027690 A1 Jan. 28, 2021

(30) Foreign Application Priority Data

Nov. 12, 2018 (CN) ..... 201811342325.2

(51) Int. Cl.
*G09G 3/20* (2006.01)

(52) U.S. Cl.
CPC ..... *G09G 3/20* (2013.01); *G09G 2310/0275* (2013.01); *G09G 2320/0257* (2013.01);
(Continued)

(58) Field of Classification Search
CPC ..... G09G 2330/028; G09G 2330/025; G09G 3/3233; G09G 2320/0257; G09G 2320/0276
See application file for complete search history.

(56) References Cited

U.S. PATENT DOCUMENTS

2009/0243564 A1* 10/2009 Kajita ..... G01R 19/16542 323/234
2011/0069059 A1* 3/2011 Lee ..... G05F 1/56 345/212
2011/0148314 A1* 6/2011 Lin ..... H05B 45/46 315/192

FOREIGN PATENT DOCUMENTS

CN 1780081 A 5/2006
CN 101534587 A 9/2009
(Continued)

OTHER PUBLICATIONS

Chinese Office Action, Nov. 27, 2019, for HKC Corporation Limited, Chinese Application No. 201811342325.2, filed Nov. 12, 2018.
(Continued)

*Primary Examiner* — Gerald Johnson
(74) *Attorney, Agent, or Firm* — Law Offices of Albert Wai-Kit Chan, PLLC

(57) ABSTRACT

Disclosed are a control circuit, a display apparatus and a control method for a control circuit. An input end of a voltage control circuit is connected to a first power input end, and an output end of the voltage control circuit is connected to a first input end of a voltage detection circuit; a second input end of the voltage detection circuit is connected to a second power input end, and an output end of the voltage detection circuit is connected to a controlled end of a switch circuit; an input end of the switch circuit is connected to the first power input end, and an output end of the switch circuit is connected to an input end of the discharging circuit.

20 Claims, 2 Drawing Sheets

(52) U.S. Cl.
CPC ..... *G09G 2320/0276* (2013.01); *G09G 2330/027* (2013.01)

(56) References Cited

FOREIGN PATENT DOCUMENTS

| | | | |
|---|---|---|---|
| CN | 101742801 | A | 6/2010 |
| CN | 102842292 | A | 12/2012 |
| CN | 103391016 | A | 11/2013 |
| CN | 204558001 | U | 8/2015 |
| CN | 106558289 | A | 4/2017 |
| CN | 106952628 | A | 7/2017 |
| CN | 108231030 | A | 6/2018 |

OTHER PUBLICATIONS

International Search Report, dated Jul. 30, 2019, for HKC Corporation Limited, International Application No. PCT/CN2018/122163, filed Dec. 19, 2018.
Written Opinion of International Search Authority, dated Jul. 30, 2019, for HKC Corporation Limited, International Application No. PCT/CN2018/122163, filed Dec. 19, 2018.

* cited by examiner

CONTROL CIRCUIT, DISPLAY APPARATUS, AND CONTROL METHOD FOR CONTROL CIRCUIT

CROSS REFERENCE TO RELATED APPLICATIONS

The present disclosure is the National Stage of International Application No. PCT/CN2018/122163, filed Dec. 19, 2018, which claims the priority to Chinese Patent Application No. 201811342325.2, filed Nov. 12, 2018 with the China National Intellectual Property Administration and entitled "CONTROL CIRCUIT, DISPLAY APPARATUS, AND CONTROL METHOD FOR CONTROL CIRCUIT", the entirety of which is hereby incorporated herein by reference.

TECHNICAL FIELD

The present disclosure relates to the field of display technology, and more particularly relates to a control circuit, a display apparatus, and a control method for a control circuit.

BACKGROUND

Charge stored in a display panel is discharged when the display apparatus is turned off. The bigger the size of the display apparatus is, the longer the time duration required for the electric discharge. A longer time duration for the electric discharge brings about a more obvious persistence of image on the display panel. To avoid the persistence of image, the charge stored in the display panel needs to be discharged more rapidly when the display apparatus is turned off.

In the display apparatus, a power supply chip receives an input voltage of 12V. In turn, the power supply chip outputs a main voltage VAA to a source driver and a gamma correction circuit, outputs a digital logic voltage VDD to the source driver circuit, the gamma correction circuit and a timing control circuit, and outputs a turn-on voltage VGH and a turn-off voltage VGL to a gate driver.

When the display is turned off, the 12V voltage input to the power supply chip drops down to a low voltage protection level of the power supply chip, making the power supply chip out of operation. At the same time, the VAA, VDD, VGH, and VGL are powered down, among which the VDD is discharged fastest, while the VAA and VGH are discharged slowest.

It is found that how soon the VAA discharges has a great influence on the persistence of image. The faster the VAA is discharged, the less obvious the persistence of image is. To restrain the persistence of image, a ground resistance may be arranged at each power supply node in the power supply circuit to accelerate the electric discharge of the charge in the display panel. The smaller the resistance is, the faster the electric discharge rate is. However, the ground resistance would increase power consumption of the whole system.

SUMMARY

The present disclosure is to provide a control circuit, a display apparatus, and a control method for the control circuit, aiming to reduce the persistence of image when the display apparatus is turned off.

In one aspect, the present disclosure provides a control circuit, including:

a first power input end and a second power input end, connected to a power supply;

a voltage control circuit, an input end of the voltage control circuit being connected to the first power input end;

a voltage detection circuit, a first input end of the voltage detection circuit being connected to an output end of the voltage control circuit, and a second input end of the voltage detection circuit being connected to the second power input end;

a switch circuit, a controlled end of the switch circuit being connected to an output end of the voltage detection circuit, and an input end of the switch circuit being connected to the first power input end; and a discharging circuit, an input end of the discharging circuit being connected to an output end of the switch circuit; where, the voltage control circuit is configured to output a corresponding reference voltage signal to the voltage detection circuit according to a voltage signal input by the first power input end;

the voltage detection circuit is configured to output a corresponding voltage detection signal to the switch circuit in response to a voltage signal input by the second power input end dropping down to the reference voltage signal;

the switch circuit is configured to be on according to the voltage detection signal; and the discharging circuit is configured to discharge when the switch circuit is on.

In another aspect, the present disclosure provides a display apparatus, including: a display panel, a circuit board and a control circuit, the circuit board is connected with the display panel, the control circuit is arranged on the circuit board; and the control circuit includes:

a first power input end and a second power input end, connected to a power supply;

a voltage control circuit, an input end of the voltage control circuit being connected to the first power input end;

a voltage detection circuit, a first input end of the voltage detection circuit being connected to an output end of the voltage control circuit, and a second input end of the voltage detection circuit being connected to the second power input end;

a switch circuit, a controlled end of the switch circuit being connected to an output end of the voltage detection circuit, and an input end of the switch circuit being connected to the first power input end; and a discharging circuit, an input end of the discharging circuit being connected to an output end of the switch circuit; where, the voltage control circuit is configured to output a corresponding reference voltage signal to the voltage detection circuit according to a voltage signal input by the first power input end;

the voltage detection circuit is configured to output a corresponding voltage detection signal to the switch circuit in response to a voltage signal input by the second power input end dropping down to the reference voltage signal;

the switch circuit is configured to be on according to the voltage detection signal; and the discharging circuit is configured to discharge when the switch circuit is on.

In still another aspect, the present disclosure provides a control method for a control circuit, the control circuit including a first power input end and a second power input end that are connected to a power supply, a voltage control circuit, a voltage detection circuit, a switch circuit, and a discharging circuit; where the control method includes:

step S1, outputting, by the voltage control circuit, a corresponding reference voltage signal to the voltage detection circuit according to a voltage signal input by the first power input end;

step S2, outputting, by the voltage detection circuit, a corresponding voltage detection signal to the switch circuit when a voltage signal input by the second power input end drops down to the reference voltage signal; and step S3, switching the switch circuit on according to the voltage detection signal, to drive the discharging circuit to discharge.

In the present disclosure, the voltage control circuit generates the reference voltage signal, and then outputs the reference voltage signal to the first input end of the voltage detection circuit. The voltage signal output by the second power input end is input to the second input end of the voltage detection circuit. The voltage detection circuit outputs the corresponding voltage detection signal to the switch circuit, so as to control the switch circuit to be on or off. Since the switch circuit is connected in series with the discharging circuit, the discharging circuit is allowed to implement electric discharge when the switch circuit is on, so as to reduce the persistence of image. In addition, the discharging circuit would not implement electric discharge when the switch circuit is off, so as to reduce the system power consumption.

BRIEF DESCRIPTION OF THE DRAWINGS

In order to illustrate the technical solution in the embodiments of the present disclosure or the prior art more clearly, brief description would be made below to the drawings required in the embodiments of the present disclosure or the prior art. Obviously, the drawings in the following description are merely some of the embodiments of the present disclosure, and those skilled in the art could obtain other drawings according to the structures shown in the drawings without any creative efforts.

The realizing of the aim, functional characteristics and advantages of the present disclosure are further described in detail with reference to the accompanying drawings and the embodiments.

DETAILED DESCRIPTION OF THE EMBODIMENTS

The technical solutions in the embodiments of the present disclosure will be described clearly and completely combining the drawings in the embodiments of the present disclosure. Obviously, the described embodiments are only a part of the embodiments of the present disclosure, but not all of them. Based on the embodiments in the present disclosure, all other embodiments obtained by those skilled in the art without creative work shall belong to the protection scope of the present disclosure.

It should be understand that, all directional indications (such as "upper", "lower", "left", "right", "front", "back" . . . ) in the embodiments of the present disclosure are only used to explain the relative positional relationship, motion, and the like, between components in a certain posture. If the particular posture changes, the directional indication changes accordingly.

In addition, terms such as "first" and "second" are used herein for purposes of description and are not intended to indicate or imply relative importance or to imply the number of indicated technical features. Thus, the features defined with "first" and "second" may comprise or imply at least one of these features. In the description of the present disclosure, "a plurality of" means two or more than two, unless specified otherwise.

In order to reduce the persistence of vision when the display apparatus is turned off, the control circuit according to the present disclosure may be integrated in the source driver, or be integrated in the gamma correction circuit P-Gamma IC. By integrating the control circuit according to the present disclosure in the source driver and/or the gamma correction circuit P-Gamma IC, the persistence of vision can be effectively reduced when the display apparatus is turned off.

Figure 1:
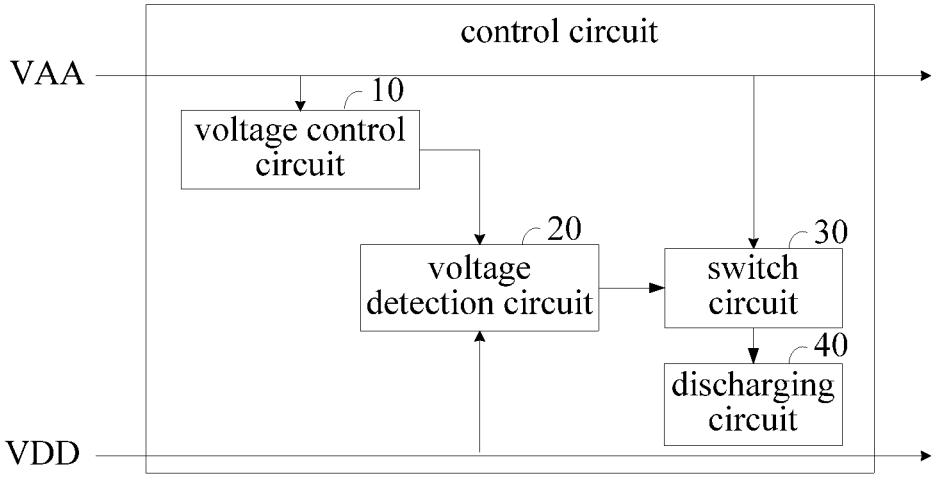
FIG. 1 is a module diagram illustrating a control circuit according to an embodiment of the present disclosure.

Referring to FIG. 1, in an embodiment according to the present disclosure, a control circuit includes a first power input end (not labeled) and a second power input end (not labeled) that are connected to a power supply, a voltage control circuit 10, a voltage detection circuit 20, a switch circuit 30, and a discharging circuit 40. An input end of the voltage control circuit 10 is connected with the first power input end, an output end of the voltage control circuit 10 is connected with a first input end of the voltage detection circuit 20, a second input end of the voltage detection circuit 20 is connected with the second power input end, an output end of the voltage detection circuit 20 is connected with a controlled end of the switch circuit 30, an input end of the switch circuit 30 is connected with the first power input end, and an output end of the switch circuit 30 is connected with an input end of the discharging circuit 40.

In this embodiment, the voltage control circuit 10 outputs a corresponding reference voltage signal to the voltage detection circuit 20 according to a received voltage signal input by the first power input end. The voltage control circuit 10 may be a voltage regulator, or other kinds of circuits known in the related art, which is not limited herein.

In this embodiment, the voltage detection circuit 20 outputs a corresponding voltage detection signal to the switch circuit 30 when the received voltage signal input by the second power input end drops down to the reference voltage signal, so as to control the switch circuit 30 to be on. The voltage detection circuit 20 may be a circuit of sampling resistor voltage dividing detection, voltage comparator or Hall sensor and so on, which is not limited herein.

In this embodiment, the switch circuit 30 has ON and OFF states, which may be realized by using various transistor components, such as an insulated field effect transistor, a triode, and a composite switch circuit composed of a plurality of transistors, which is not limited herein.

In this embodiment, the discharging circuit 40 is configured to discharge when the switch circuit 30 is on. The discharging circuit 40 may be a resistor, a diode, or a combined discharging circuit of a resistor and a diode.

As an example, the control circuit integrated within the source driving circuit is described. In the present disclosure, the voltage control circuit 10 generates the corresponding reference voltage signal according to the received main voltage VAA input by the first power input end. In practice, the main voltage VAA needs to be boosted and then input to the source driving circuit. The voltage input to the source driving circuit may be 15V to 18V. The reference voltage signal is input to the first input end of the voltage detection circuit 20, and the digital logic voltage VDD input by the second power input end is input to the second input end of the voltage detection circuit 20. The digital logic voltage VDD may be 3.3V, and may also be determined according to actual needs. When the display apparatus is turned off, the main voltage VAA input by the first power input end and the digital logic voltage VDD input by the second power input end start to drop down. When the digital logic voltage VDD drops below the reference voltage signal, the voltage detection circuit 20 outputs a corresponding voltage detection signal, such as a high-level voltage detection signal, to the switch circuit 30 to control the switch circuit 30 to be on. The switch circuit 30 is connected in series with the discharging circuit 40, thus, the discharging circuit 40 and the first power input end are in a closed-circuit state, when the switch circuit 30 is on. In this case, the main voltage VAA is rapidly discharged through the discharging circuit 40. When the display apparatus is in normal operation, since the reference voltage signal input to the voltage detection circuit 20 is smaller than the digital logic voltage VDD, the switch circuit 30 is off, and accordingly the discharging circuit 40 and the first power input end are in an open-circuit state. In this case, the main voltage VAA cannot be discharged through the discharging circuit 40. By this way, the persistence of image can be effectively reduced, and also the power consumption of the system can be avoided from increasing.

Figure 2:
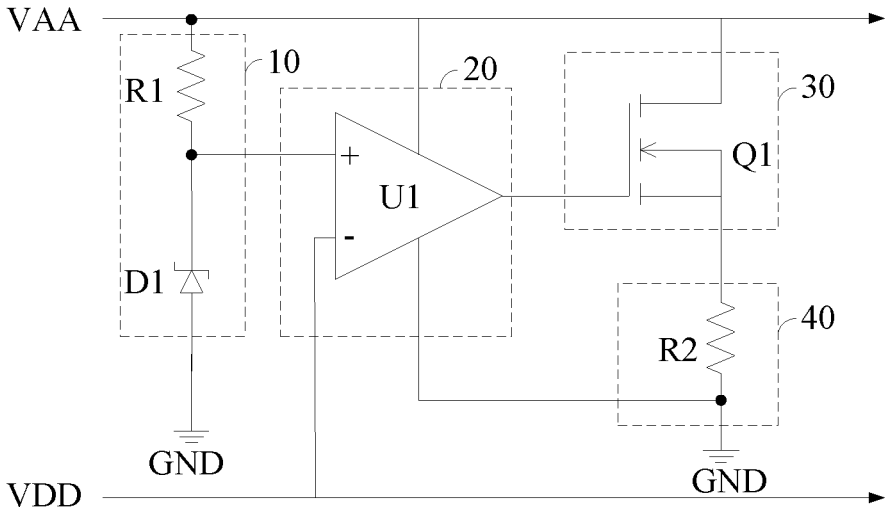
FIG. 2 is a structure diagram illustrating a control circuit according to an embodiment of the present disclosure.

In an embodiment, referring to FIG. 2, the voltage control circuit 10 includes a first resistor R1 and a Zener diode D1. A first end of the first resistor R1 is the input end of the voltage control circuit 10, a second end of the resistor R1 is the output end of the voltage control circuit 10 and is connected to a cathode of the Zener diode D1, and an anode of the Zener diode D1 is grounded.

Specifically, the voltage control circuit 10 receives the voltage signal input by the first power input end, namely a main voltage VAA, and outputs the corresponding reference voltage signal to the voltage detection circuit 20. The voltage control circuit 10 outputs the fixed reference voltage signal to the voltage detection circuit 20 before the main voltage VAA input by the first power input end is larger than a stabilizing voltage of the Zener diode D1. In practice, the voltage signal input by the second power input end, namely a digital logic voltage VDD, may be 3.3V, and the magnitude of the reference voltage signal may be determined according to the stabilizing voltage of the selected Zener diode D1. The stabilizing voltage of the Zener diode D1 may be ⅗ to ⅘ of the digital logic voltage VDD, or lower than the digital logic voltage VDD, such as a 2.7V. The stabilizing voltage of the Zener diode cannot be too low to ensure that there is plenty of time for the main voltage VAA to be discharged through the discharging circuit 40 when the display apparatus is turned off. And by arranging the first resistor R1 between the Zener diode D1 and the first power input end, it can prevent the Zener diode D1 from stabilizing the main voltage VAA to the stabilizing voltage of the Zener diode D1.

In an embodiment, referring to FIG. 2, the voltage detection circuit 20 may use a voltage comparator U1. A non-inverting input end of the voltage comparator U1 is the first input end of the voltage detection circuit 20, an inverting input end of the voltage comparator U1 is the second input end of the voltage detection circuit 20, and an output end of the voltage comparator U1 is the output end of the voltage detection circuit 20.

Specifically, the non-inverting input end of the voltage comparator U1 receives the reference voltage signal output by the voltage control circuit 10, and the inverting input end of the voltage comparator U1 receives the digital logic voltage VDD output by the second power input end. The voltage comparator U1 outputs a high level if the voltage input to the non-inverting input end is greater than the voltage input to the inverting input end, otherwise the voltage comparator U1 outputs a low level. When the display apparatus is in normal operation, the digital logic voltage VDD is higher than the reference voltage signal. At this time, the voltage comparator U1 outputs a low-level voltage detection signal which acts on the switch circuit 30 to turn off the switch circuit 30. When the display apparatus is turned off, the digital logic voltage VDD starts to drop, and when the digital logic voltage drops below the reference voltage signal, the voltage comparator U1 outputs a high-level voltage detection signal, so as to control the switch circuit 30 to be on. Therefore, the voltage detection signal output from the voltage detection circuit 20 can be used to control the switch circuit to be on or off.

In an embodiment, referring to FIG. 2, the switch circuit 30 may use N-type insulated field effect transistor Q1, that is, a N-MOS transistor. The gate of the N-MOS transistor is the controlled end of the switch circuit 30, the drain of the N-MOS transistor is the input end of the switch circuit 30, and the source of the N-MOS transistor is the output end of the switch circuit 30. In other embodiments, the switch circuit 30 may also adopt a triode, or other composite switch circuit composed of a plurality of transistors, which are is limited herein.

Specifically, when the display apparatus is in normal operation, the digital logic voltage VDD input to the voltage detection circuit 20 is greater than the reference voltage signal, and the voltage detection circuit 20 outputs the low-level voltage detection signal to the gate of the N-MOS transistor, so as to control N-MOS transistor to be off. Since the discharging circuit 40 is connected in series with the switch circuit 30, at this time, the discharging circuit 40 and the first power input end are in the open-circuit state. When the display apparatus is turned off, the digital logic voltage VDD starts to drop. And when the digital logic voltage VDD is lower than the reference voltage signal, the voltage detection circuit 20 outputs the high-level voltage detection signal to the gate of the N-MOS transistor, so as to control the N-MOS transistor to be on. At this time, the first power input end and the discharging circuit 40 are in the closed-circuit state. By controlling the switch circuit 30 to be on and off, it is possible to control that whether the discharging circuit 40 is connected to the first power input end to be discharged.

In an embodiment, referring to FIG. 2, the discharging circuit 40 includes a second resistor R2. A first end of the second resistor R2 is the input end of the discharging circuit 40, and a second end of the second resistor R2 is grounded.

Specifically, the second resistor R2 is connected in series with the switch circuit 30. The switch circuit 30 is off when the display apparatus is in normal operation. At this time, the second resistor R2 is in open-circuit connection with the first power input end, and no current flows through the second resistor R2. Therefore, when the display apparatus is in normal operation, the second resistor R2 does not discharge, which would not increase power consumption in the system.

And the switch circuit 30 is switched to the on state from the off state when the display apparatus is turned off. At this time, the second resistor R2 is closed-circuit connection with the first power input end, and the main voltage VAA can be discharged through the second resistor R2. By this way, the persistence of vision can be effectively reduced, also an increase in the system power consumption due to addition of the control circuit can be avoided.

The present disclosure also provides a display apparatus. The display apparatus includes a display panel, a circuit board and a control circuit as described above. The circuit board is connected to the display panel, and the control circuit is arranged on the circuit board. The specific structure of the control circuit can be referred to the above embodiments, which are not detailed herein. It can be understood that, since the display apparatus according to the present disclosure includes the above control circuit, the embodiments thereof include all the technical solutions of all the embodiments of the control circuit, and identical technical effects can also be achieved, thus are not detailed herein.

In this embodiment, the display apparatus may be one that includes a display panel, such as a television, a tablet, or a mobile phone.

Figure 3:
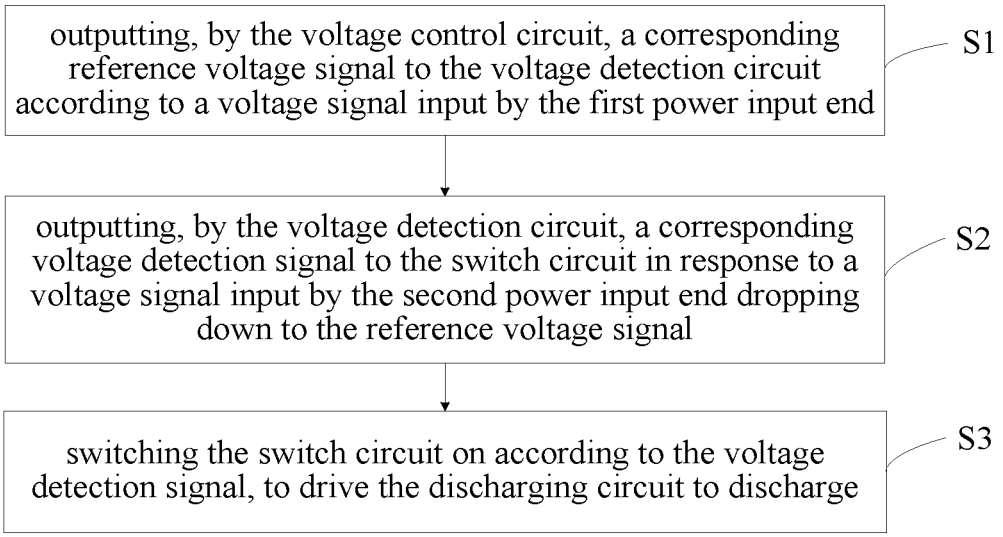
FIG. 3 is a flowchart diagram illustrating a control method for control circuit according to an embodiment of the present disclosure.
Figure 4:
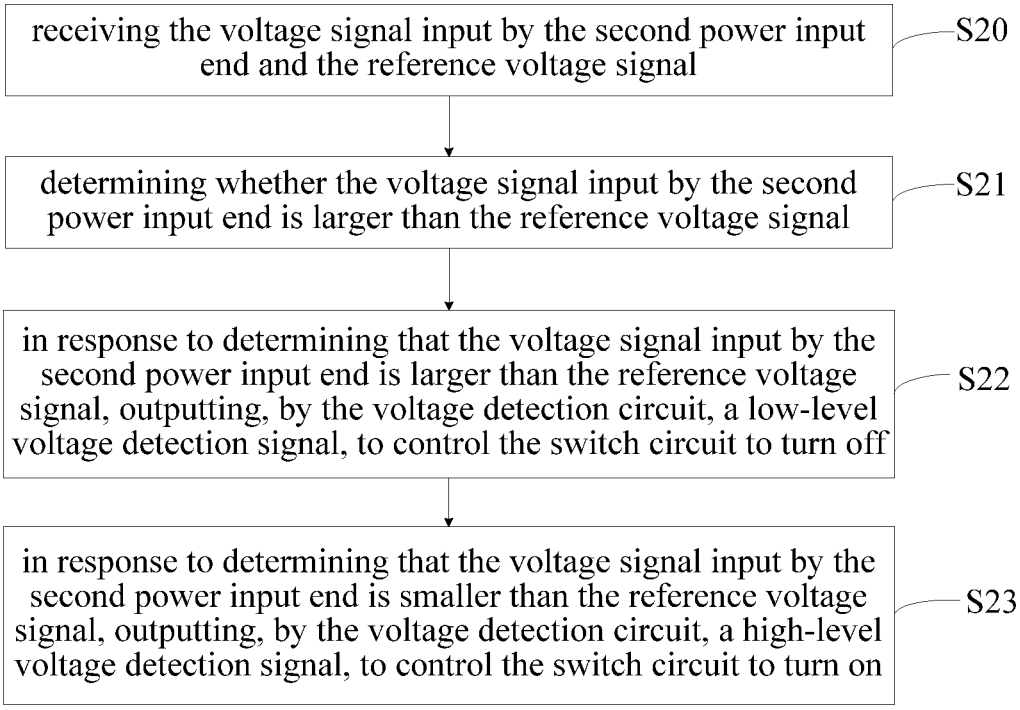
FIG. 4 is a detailed flowchart diagram illustrating step S2 according to an embodiment of the present disclosure.

The present disclosure also provides a control method of the control circuit. Referring to FIG. 3 and FIG. 4, the control method for the control circuit includes:

Step S1, outputting, by the voltage control circuit 10, a corresponding reference voltage signal to the voltage detection circuit 20, according to a voltage signal input by the first power input end;

Step S2, outputting, by the voltage detection circuit 20, a corresponding voltage detection signal to the switch circuit 30 when a voltage signal input by the second power input end drops down to the reference voltage signal;

Step S3, switching the switch circuit on according to the voltage detection signal, to drive the discharging circuit to discharge.

Optionally, step S2 includes:

Step S20, receiving the voltage signal input by the second power input end and the reference voltage signal;

Step S21, determining whether the voltage signal input by the second power input end is larger than the reference voltage signal;

Step S22, outputting, by the voltage detection circuit 20, a low-level voltage detection signal, if the voltage signal input by the second power input end is larger than the reference voltage signal, to control the switch circuit 30 to turn off;

Step S23, outputting, by the voltage detection circuit 20, a high-level voltage detection signal, if the voltage signal input by the second power input end is smaller than the reference voltage signal, to control the switch circuit 30 to be on.

The structure of the control circuit is as shown in FIG. 2. The first power input end is connected to the cathode of the Zener diode D1 via the first resistor R1, and the anode of the Zener diode D1 is grounded. The non-inverting input end of the voltage comparator U1 is connected to the cathode of the Zener diode D1, the inverting input end of the voltage comparator U1 is connected to the second power input end. The output end of the voltage comparator U1 is connected to the gate of the N-MOS transistor, the drain of the N-MOS transistor is connected to the first power input end, and the source of the N-MOS transistor is connected to the ground end via the second resistor R2.

Specifically, the main voltage VAA input by the first power input end is regulated by the Zener diode D1 after being through the first resistor R1, so as to obtain the reference voltage signal. The reference voltage signal is output to the non-inverting input end of the voltage comparator U1, and the digital logic voltage VDD input by the second power input end is output to the inverting input end of the voltage comparator U1. When the display apparatus is in normal operation, the digital logic voltage VDD is greater than the reference voltage signal, and the voltage comparator U1 outputs a low-level voltage detection signal to the gate of the N-MOS transistor, at which time the N-MOS transistor is turned off, and no current flows through the second resistor R2. Current flows through. When the display apparatus is turned off, the main voltage VAA and the digital logic voltage VDD start to decrease. Since the digital logic voltage VDD drops faster than the main voltage VAA, when the digital logic voltage VDD drops below the reference voltage signal, the voltage comparator U1 outputs a high-level voltage detection signal to the gate of the N-MOS transistor, at which time the N-MOS transistor is turned on, and the main voltage VAA is discharged through the second resistor R2. In the present disclosure, speeding up the discharge of the main voltage VAA reduces the persistence of vision effectively.

The foregoing are only illustrative embodiments in accordance with the present disclosure and therefore not intended to limit the patentable scope of the present disclosure. Any equivalent structure or flow transformations that are made taking advantage of the specification and accompanying drawings of the disclosure and any direct or indirect applications thereof in other related technical fields are within the protection scope of the present disclosure.

What is claimed is:

1. A control circuit, wherein, the control circuit comprises:

a first power input end and a second power input end that are directly connected to a power supply;

a voltage control circuit, an input end of the voltage control circuit being connected to the first power input end;

a voltage detection circuit, a first input end of the voltage detection circuit being connected to an output end of the voltage control circuit, and a second input end of the voltage detection circuit being connected to the second power input end;

a switching circuit, a controlled end of the switching circuit being connected to an output end of the voltage detection circuit, and an input end of the switching circuit being connected to the first power input end; and a discharging circuit, an input end of the discharging circuit being connected to an output end of the switching circuit; the second power input end is not directly connected with the discharging circuit; wherein, the voltage control circuit is configured to output a corresponding reference voltage signal to the voltage detection circuit according to a voltage signal input by the first power input end;

the voltage detection circuit is configured to output a corresponding voltage detection signal to the switching circuit when a voltage signal input by the second power input end drops down to the reference voltage signal;

the switching circuit is configured to be on according to the voltage detection signal; and the discharging circuit is configured to discharge when the switching circuit is on.

2. The control circuit of claim 1, wherein, the voltage control circuit comprises a first resistor and a Zener diode, a first end of the first resistor is the input end of the voltage control circuit, a second end of the first resistor is the output end of the voltage control circuit and is connected to a cathode of the Zener diode, and an anode of the Zener diode is grounded.

3. The control circuit of claim 1, wherein, the voltage detection circuit is a voltage comparator, a non-inverting input end of the voltage comparator is the first input end of the voltage detection circuit, an inverting input end of the voltage comparator is the second input end of the voltage detection circuit, and an output end of the voltage comparator is the output end of the voltage detection circuit.

4. The control circuit of claim 1, wherein, the switching circuit comprises an N-type insulated field effect transistor, the gate of the N-type insulated field effect transistor is the controlled end of the switching circuit, the drain of the N-type insulated field effect transistor is the input end of the switching circuit, and the source of the N-type insulated field effect transistor is the output end of the switching circuit.

5. The control circuit of claim 1, wherein, the discharging circuit comprises a second resistor, a first end of the second resistor is the input end of the discharging circuit, and a second end of the second resistor is grounded.

6. The control circuit of claim 1, wherein, the switching circuit is connected in series with the discharging circuit.

7. The control circuit of claim 1, wherein, the control circuit is integrated in a source driver circuit.

8. The control circuit of claim 1, wherein, the control circuit is integrated in a gamma correction circuit.

9. A display device, wherein, the display device comprises a display panel, a circuit board and a control circuit, the circuit board is connected with the display panel, the control circuit is arranged on the circuit board; and the control circuit comprises:

a first power input end and a second power input end that are directly connected to a power supply;

a voltage control circuit, an input end of the voltage control circuit being connected to the first power input end;

a voltage detection circuit, a first input end of the voltage detection circuit being connected to an output end of the voltage control circuit, and a second input end of the voltage detection circuit being connected to the second power input end;

a switching circuit, a controlled end of the switching circuit being connected to an output end of the voltage detection circuit, and an input end of the switching circuit being connected to the first power input end; and a discharging circuit, an input end of the discharging circuit being connected to an output end of the switching circuit; wherein, the second power input end is not directly connected with the discharging circuit;

the voltage control circuit is configured to output a corresponding reference voltage signal to the voltage detection circuit according to a voltage signal input by the first power input end;

the voltage detection circuit is configured to output a corresponding voltage detection signal to the switching circuit when a voltage signal input by the second power input end drops down to the reference voltage signal;

the switching circuit is configured to be on according to the voltage detection signal; and the discharging circuit is configured to discharge when the switching circuit is on.

10. The display device of claim 9, wherein, the voltage control circuit comprises a first resistor and a Zener diode, a first end of the first resistor is the input end of the voltage control circuit, a second end of the first resistor is the output end of the voltage control circuit and is connected to a cathode of the Zener diode, and an anode of the Zener diode is grounded.

11. The display device of claim 9, wherein, the voltage detection circuit is a voltage comparator, a non-inverting input end of the voltage comparator is the first input end of the voltage detection circuit, an inverting input end of the voltage comparator is the second input end of the voltage detection circuit, and an output end of the voltage comparator is the output end of the voltage detection circuit.

12. The display device of claim 9, wherein, the switching circuit comprises an N-type insulated field effect transistor, the gate of the N-type insulated field effect transistor is the controlled end of the switching circuit, the drain of the N-type insulated field effect transistor is the input end of the switching circuit, and the source of the N-type insulated field effect transistor is the output end of the switching circuit.

13. The display device of claim 9, wherein, the discharging circuit comprises a second resistor, a first end of the second resistor is the input end of the discharging circuit, and a second end of the second resistor is grounded.

14. The display device of claim 9, wherein, the switching circuit is connected in series with the discharging circuit.

15. A display device as claimed in claim 9, wherein, the control circuit is integrated in a source driver circuit.

16. The display device of claim 9, wherein, the control circuit is integrated in a gamma correction circuit.

17. A control method for a control circuit, the control circuit comprising a first power input end and a second power input end that are directly connected to a power supply, a voltage control circuit, a voltage detection circuit, a switching circuit, and a discharging circuit, an input end of the voltage control circuit being connected to the first power input end; a first input end of the voltage detection circuit being connected to an output end of the voltage control circuit, and a second input end of the voltage detection circuit being connected to the second power input end; the second power input end is not directly connected with the discharging circuit; wherein, the control method comprises:

step S1, outputting, by the voltage control circuit, a corresponding reference voltage signal to the voltage detection circuit according to a voltage signal input by the first power input end;

step S2, outputting, by the voltage detection circuit, a corresponding voltage detection signal to the switching circuit when a voltage signal input by the second power input end drops down to the reference voltage signal; and step S3, driving the discharging circuit to discharge, by turning the switching circuit on according to the voltage detection signal.

18. The control method of claim 17, wherein, the step S2 comprises:

step S20, receiving the voltage signal input by the second power input end and the reference voltage signal;

step S21, determining whether the voltage signal input by the second power input end is larger than the reference voltage signal;

step S22, outputting, by the voltage detection circuit, a low-level voltage detection signal, if the voltage signal input by the second power input end is larger than the reference voltage signal, to control the switching circuit to turn off; and step S23, outputting, by the voltage detection circuit, a high-level voltage detection signal, if the voltage signal input by the second power input end is smaller than the reference voltage signal, to control the switching circuit to turn on.

19. The method of claim 17, wherein, the control circuit is integrated in a source driver circuit.

20. The method of claim 17, wherein, the control circuit is integrated in a gamma correction circuit.

* * * * *